US008797250B2

(12) United States Patent
Ota

(10) Patent No.: US 8,797,250 B2
(45) Date of Patent: Aug. 5, 2014

(54) LIQUID CRYSTAL DISPLAY DEVICE, AND TIMING CONTROLLER AND SIGNAL PROCESSING METHOD USED IN SAME

(75) Inventor: Shinji Ota, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 716 days.

(21) Appl. No.: 12/752,535

(22) Filed: Apr. 1, 2010

(65) Prior Publication Data

US 2010/0253672 A1 Oct. 7, 2010

(30) Foreign Application Priority Data

Apr. 7, 2009 (JP) ..... 2009-093471

(51) Int. Cl.
*G09G 3/36* (2006.01)

(52) U.S. Cl.
USPC ..... 345/99

(58) Field of Classification Search
CPC . G09G 3/2085; G09G 3/2088; G09G 3/3644; G09G 3/3648; G09G 3/3651; G09G 3/3655; G09G 3/3659; G09G 3/3666
USPC ..... 345/87–104
See application file for complete search history.

(56) References Cited

U.S. PATENT DOCUMENTS 5,877,740 A * 3/1999 Hirakata et al. ..... 345/103
6,867,759 B1 * 3/2005 Baek et al. ..... 345/99
7,639,244 B2 12/2009 Ku et al.
8,232,953 B2 7/2012 Tsukio
2003/0052873 A1 * 3/2003 Ueda ..... 345/211
2004/0222981 A1 * 11/2004 Kobayashi et al. ..... 345/204
2006/0290641 A1 * 12/2006 Ku et al. ..... 345/98
2009/0231265 A1 * 9/2009 Tsukio ..... 345/104
2010/0060617 A1 3/2010 Ku et al.

FOREIGN PATENT DOCUMENTS

JP 10-207434 8/1998
JP 2006-106331 4/2006
JP 2006-267313 10/2006
JP 2006-350341 12/2006
JP 2009-151243 7/2009
JP 2009-217117 9/2009

OTHER PUBLICATIONS

Japanese Official Action—2009-093471—Oct. 23, 2012.

* cited by examiner

*Primary Examiner* — Chanh Nguyen
*Assistant Examiner* — Sanghyuk Park
(74) *Attorney, Agent, or Firm* — Young & Thompson

(57) ABSTRACT

A liquid crystal display device is provided which is capable of reducing EMI (ElectraMagnetic Interference) noises while simultaneously responding to requirements for the high-speed transmission of image data, miniaturization and thinning of a signal processing board. A timing controller outputs, in accordance with an input data signal and input clock signal, a data line driving circuit controlling signal, internal data signal, internal clock signal to a data line driving circuit and outputs a scanning line driving circuit controlling signal to a scanning line driving circuit. The timing controller has a clock signal frequency setting mode in which a frequency of each of clock signals is set to a different value and the clock signals are supplied to the data line driving circuits and other data line driving circuits in one region and another region.

13 Claims, 13 Drawing Sheets

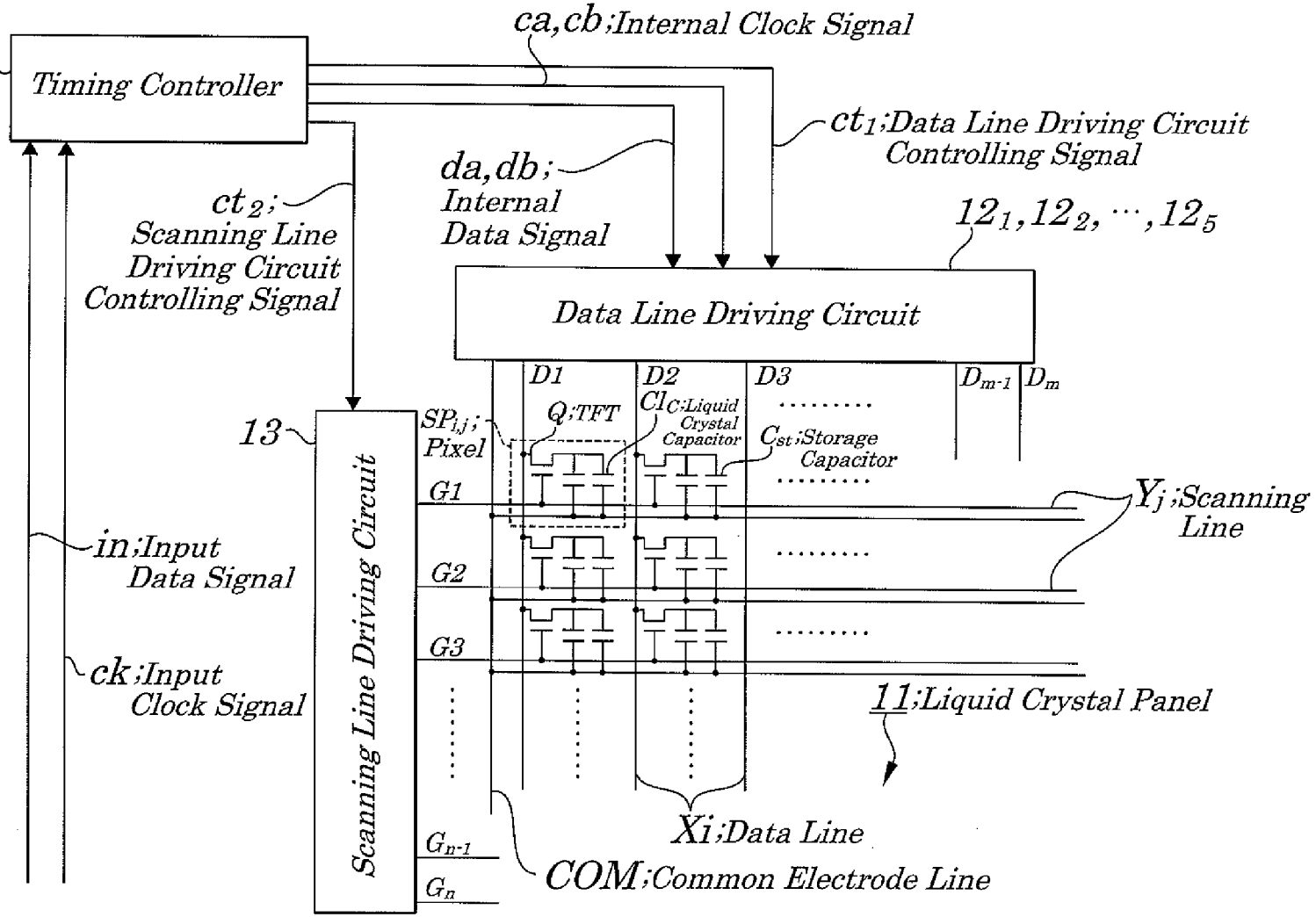
FIG. 7
14a
Timing Controller
ca, cb;Internal Clock Signal
ct1;Data Line Driving Circuit Controlling Signal
12₁, 12₂, ···, 12₅
Data Line Driving Circuit
da, db; Internal Data Signal
ct2; Scanning Line Driving Circuit Controlling Signal
13
Scanning Line Driving Circuit
in;Input Data Signal
ck;Input Clock Signal
Yj;Scanning Line
11;Liquid Crystal Panel
Xi;Data Line
COM;Common Electrode Line
Dm
Dm-1
D3
D2
D1
Cst;Storage Capacitor
Clc;Liquid Crystal Capacitor
Q;TFT
SPi,j; Pixel
G1
G2
G3
Gn-1
Gn

LIQUID CRYSTAL DISPLAY DEVICE, AND TIMING CONTROLLER AND SIGNAL PROCESSING METHOD USED IN SAME

INCORPORATION BY REFERENCE

This application is based upon and claims the benefit of priority from Japanese Patent Application No. 2009-093471, filed on Apr. 7, 2009, the disclosure of which is incorporated herein in its entirely by reference.

BACKGROUND OF THE INVENTION

1. Field of the Invention

The present invention relates to a liquid crystal display device, and a timing controller and a signal processing method to be used in the liquid crystal display device and more particularly to the liquid crystal display device capable of simultaneously achieving reduction of noises, miniaturization and thinning of a signal processing board, and high-speed transmission of image data, and to the timing controller and the signal processing method to be used in the liquid crystal display device.

2. Description of the Related Art

In a liquid crystal display device, EMI (ElectroMagnetic Interference) noises occur in some cases. The reasons for the EMI noises are as follows:

(1) As the liquid crystal display device becomes larger in size and higher definition, an amount of image data to be transmitted to its display panel becomes enormous and the transmission of image data must be further sped up.

(2) As a moving image improving technology, a frequency having a refresh rate of 60 Hz or more is used, which causes the higher-speed transmission of image data.

(3) As components other than a display region of a display panel becomes smaller in size and thinner, a signal processing board for transmission of image data is also miniaturized and is made thinner.

Due to requests for the high-speed transmission of image data, a high-frequency component is emitted as the EMI noise from a wiring for the transmission of data signals and clock signals. Moreover, due to an insufficient area for a reference potential wiring (ground) caused by the miniaturization and thinning of a signal processing board, the EMI noises are also emitted from the reference potential wiring. Therefore, the advent of the liquid crystal display device is expected which can achieve the suppression of EMI noises and simultaneously the miniaturization and thinning of the signal processing board even when image data is to be transmitted at higher speed.

To solve this problem, a method of driving a liquid crystal display device is disclosed as the related art in Japanese Patent Application Laid-open No. 2006-267313 (Patent Reference 1). In this driving method, as shown in FIG. 12A, a frequency of an internal clock (Internal CLK) to be inputted to a source driver is set to be different from a frequency of an input clock (Input CLK) inputted from a system device during an invalid period and, therefore, a peak voltage level of a noise (GND noise) being superimposed on a reference potential wiring formed on a data side substrate having a source driver. Owing to this, the EMI noises caused by GND noises emitted from the liquid crystal display device are decreased. Also, in the case where signals from a timing controller are outputted through two ports, as shown in FIG. 12B, internal clocks (internal CLK1 and internal CLK 2) are out of phase with each other to avoid synchronization (in phase), whereby an influence by noises on the reference potential wiring can be reduced. By these method, the occurrence of peaks of noises from the reference potential wiring is reduced, thus decreasing the EMI noises.

Another attempt for the reduction of noises in a liquid crystal display device is disclosed in Japanese Patent Application Laid-open No. Heil0-207434 (Patent Reference 2). In the disclosed liquid crystal display device, signals from a timing controller are outputted through N ports and, as shown in FIG. 13A, in response to an input clock signal fHz, internal clocks from each output port are frequency-divided into a clock signal f/N, whereby EMI noises caused by a high-frequency component can be suppressed.

However, the above conventional technologies have the following problems. That is, in the liquid crystal display device disclosed in the Patent Reference 1, in the case shown in FIG. 12A, it is true that noises in the reference potential wiring during an invalid period are reduced, however, noises during the transmission of internal data signals are not decreased. Also, in the case shown in FIG. 12B, the peak noises in the reference potential wiring are reduced, however, periodic potential changes in the reference potential wiring still remain and no decrease in the influence by noises occurs.

The liquid crystal display device disclosed in the Patent Reference 2 has a problem in that, since the internal clock signals are frequency-divided into f/N, as shown in FIG. 13B, noises occur in the reference potential wiring. In this case, a display region of a display panel is divided in a manner to be equal in area, the frequencies of the internal clock signals from each output port of the timing controller are set to be equal. As a result, superimposition of phases of signals having the same frequency occurs, which causes a larger noise peak and the above problems remain unsolved.

SUMMARY OF THE INVENTION

In view of the above, it is an object of the present invention to provide a liquid crystal display device, a timing controller and a signal processing method to be used in the liquid crystal display device in which EMI noises are reduced and miniaturization and thinning of a signal processing board are also achieved even if transmission of image data is speeded up.

According to a first aspect of the present invention, there is provided a liquid crystal display device including:

a liquid crystal panel having predetermined columns of data lines, predetermined rows of scanning lines, and pixels each formed at an intersection of each of the data lines and each of the scanning lines;

a data line driving circuit to write, in accordance with a first controlling signal supplied in every horizontal period, pixel data based on a given data signal to each of the data lines in synchronization with a clock signal having a given frequency;

a scanning line driving circuit to output, in accordance with a given second controlling signal, a scanning line driving signal to be used for driving each of the scanning lines in a predetermined order; and a control unit to output, in accordance with a video signal, the first controlling signal, data signal, and clock signal, to the data line driving circuit and the second controlling signal to the scanning line driving circuit;

wherein the liquid crystal panel is divided in a column direction into a plurality of display regions, wherein the data line driving circuit to write, pixel data, in accordance with the corresponding data signal and in synchronization with each clock signal, in every display region of the liquid crystal panel, to each of the data lines, and wherein the control unit has a clock signal frequency setting mode in which each clock signal whose frequency set to a different value is supplied to the data line driving circuit in every display region.

According to a second aspect of the present invention, there is provide a timing controller to be used for a liquid crystal display device having a liquid crystal panel having predetermined columns of data lines, predetermined rows of scanning lines, and pixels each formed at an intersection of each of the data lines and each of the scanning lines, a data line driving circuit to write, in accordance with a first controlling signal supplied in every horizontal period, pixel data based on a given data signal to each of the data lines in synchronization with a clock signal having a given frequency, and a scanning line driving circuit to output, in accordance with a given second controlling signal, a scanning line driving signal to be used for driving each of the scanning lines in a predetermined order and wherein the liquid crystal panel is divided in a column direction into a plurality of display regions, wherein the data line driving circuit to write, pixel data, in accordance with the corresponding data signal and in synchronization with each of the clock signals, in every display region of the liquid crystal panel, to each of the data lines, the timing controller including a clock signal frequency setting mode in which, in accordance with a video signal, the first controlling signal, the data signal, and the clock signal are outputted to the data line driving circuit and the second controlling signal is outputted to the scanning line driving circuit and each of the clock signals whose frequency set to a different value is supplied to the data line driving circuit in every display region.

According to a third aspect of the present invention, there is provided a signal processing method to be used in a liquid crystal display device having a liquid crystal panel including predetermined columns of data lines, predetermined rows of scanning lines, and pixels each mounted at an intersection of each of the data lines and each of the scanning lines, a data line driving circuit to write, in accordance with a first controlling signal supplied in every horizontal period, pixel data based on a given data signal to each of the data lines in synchronization with a clock signal having a given frequency, a scanning line driving circuit to output, in accordance with a given second controlling signal, a scanning line driving signal to be used for driving each of the scanning lines in a predetermined order, and a control unit to output, in accordance with a video signal, the first controlling signal, the data signal, and the clock signal to the data line driving circuit and the second controlling signal to the scanning line driving circuit, and wherein the liquid crystal panel is divided in a column direction into a plurality of display regions, wherein the data line driving circuit to write, pixel data, in accordance with the corresponding data signal and in synchronization with each clock signal, in every display region of the liquid crystal panel, to each of the data lines, the signal processing method including:

a clock signal frequency setting processing in which the control unit sets a frequency of each of the clock signals to a different value and supplies each of the clock signals to the data line driving circuit in every display region.

With the above configurations, portions in which the superimposition of phases of clock signals corresponding to each display region can be reduced, whereby the EMI noises occurring in the reference potential wiring can be suppressed.

BRIEF DESCRIPTION OF THE DRAWINGS

The above and other objects, advantages, and features of the present invention will be more apparent from the following description taken in conjunction with the accompanying drawings in which:

FIG. 7 is a diagram obtained by abstracting the liquid crystal panel, data line driving circuits, scanning line driving circuit and timing controller shown in FIG. 5 according to the first exemplary embodiment;

DETAILED DESCRIPTION OF THE PREFERRED EMBODIMENTS

Best modes of carrying out the present invention will be described in further detail using various exemplary embodiments with reference to accompanying drawings. There is provided a liquid crystal display device in which, in a clock signal frequency setting mode, a controlling device is adapted to set a frequency of each of clock signals for every display region to a value at which a period during which the clock signals are in phase becomes one horizontal period.

In preferred embodiments of the present invention, in the above clock signal frequency setting mode, the above controlling device is adapted not to output portions of signals in which the clock signals are in phase. During the one horizontal period, there is a period during which the data signal is valid and there is a period during which the data signal is invalid.

The controlling device is adapted to set a frequency of each of the clock signals to a value at which a period during which the clock signals are in phase is within the invalid period.

When a liquid crystal panel is made up of a first display region being one of two portions formed by dividing the display region and of a second display region, which is smaller than the first display region, being the other of the two portions formed also by dividing the display region, the controlling device is adapted to set a wavelength of a second clock signal out of first and second clock signals each corresponding to the first and second display regions to a value at which the first and second clock signals are in phase during one horizontal period. Further, when the liquid crystal panel is made up of the first display region being one of two portions formed by dividing the display region and of the second display region, which is equal in size to the first display region, being the other of the two portions formed also by dividing the display region, the controlling device is adapted to set the wavelength of a second clock signal out of the first and second clock signals each corresponding to the first and second display regions so that the wavelength of the second clock signal is one half the above first clock signal.

Figure 1:
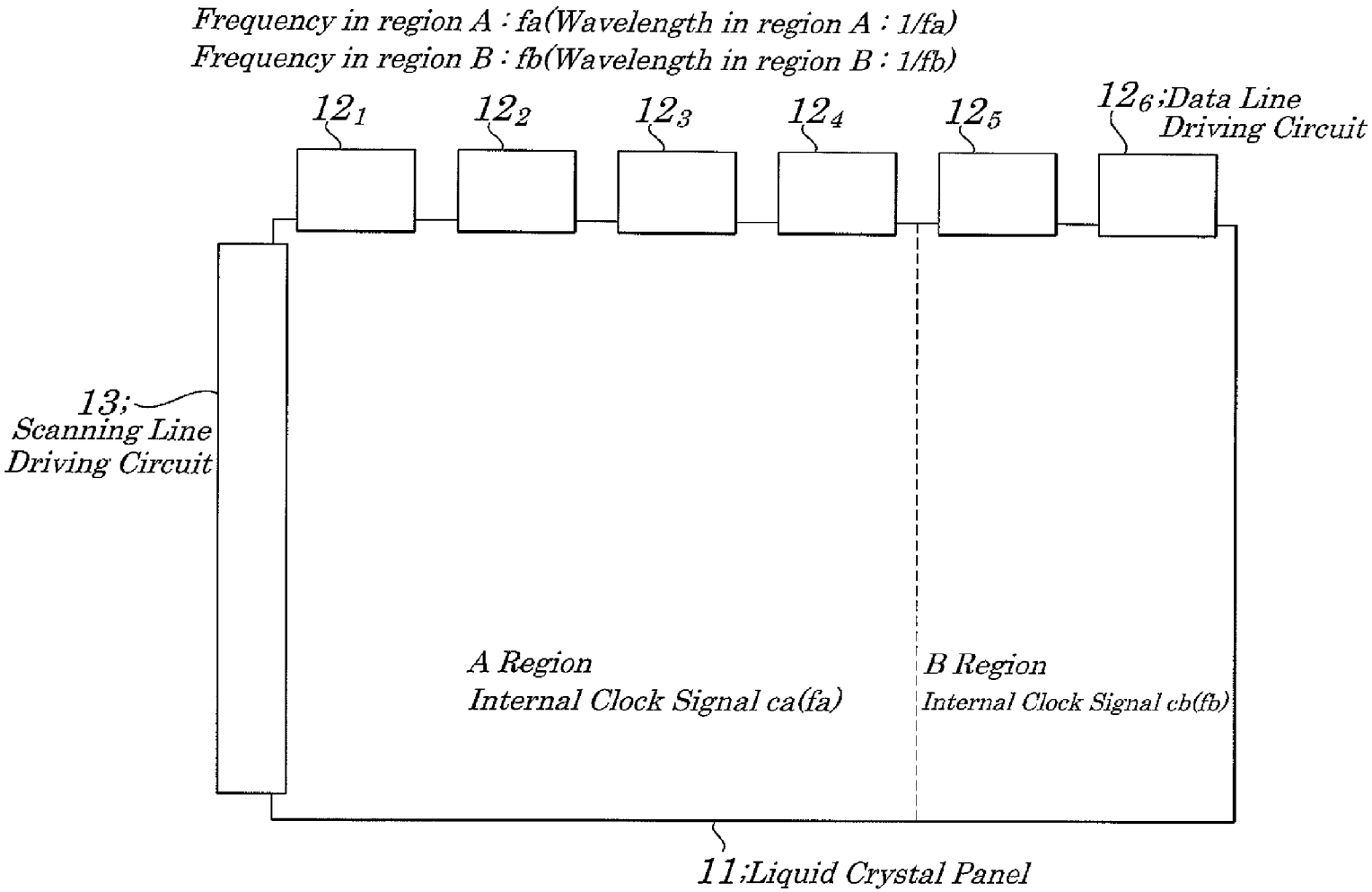
FIG. 1 is a diagram showing main portions of a liquid crystal display device explaining a basic principle of the present invention.
Figure 2:
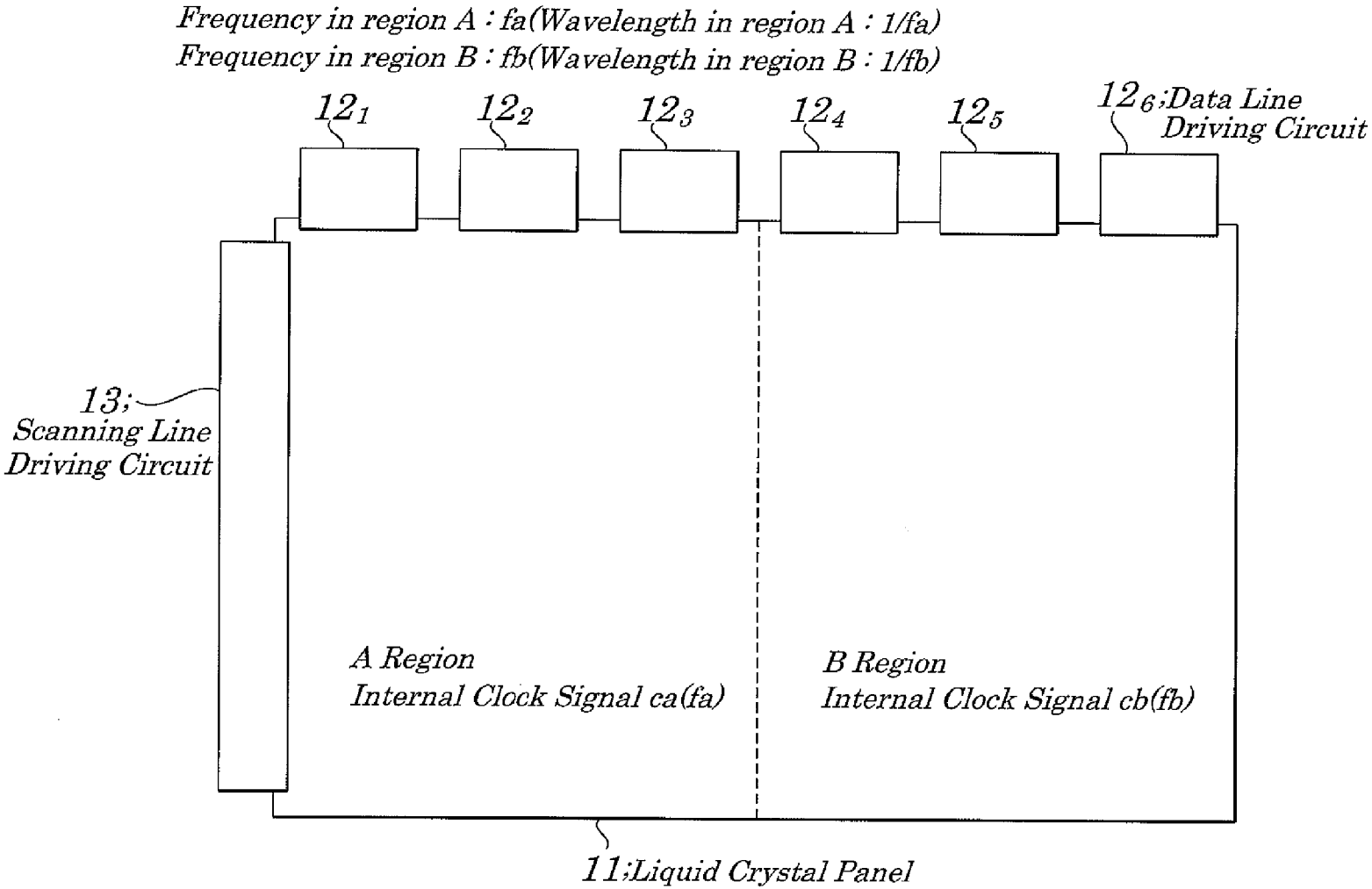
FIG. 2 is a diagram showing main portions of another liquid crystal display device explaining a basic principle of the present invention.

A basic principle of the liquid crystal display device of the present invention is described hereinafter. FIG. 1 is a diagram showing main portions of the liquid crystal display device explaining the basic principle of the present invention. FIG. 2 is a diagram showing main portions of another liquid crystal display device explaining a basic principle of the present invention. The liquid crystal display device shown in FIG. 1 includes a liquid crystal display panel 11, data line driving circuits $\mathbf{12}_1$, $\mathbf{12}_2$, . . . , $\mathbf{12}_6$, and a scanning line driving circuit 13. In the liquid crystal display device in FIG. 1, the liquid crystal panel 11 is divided into a display region A and a display region B, each having a different area. Also, in the liquid crystal display device in FIG. 2, the liquid crystal panel 11 is divided into a display region Ae and a display region Be, each having an equal area. When a frequency of an internal clock signal ca corresponding to each of the display regions A and Ae is fa and a frequency of an internal clock signal cb corresponding to each of the display regions B and Be is fb, a wavelength of each of the internal clock signals ca and cb is respectively 1/fa and 1/fb. Now, it is assumed that the number of clocks during one horizontal period in the display region A is $N_A$ and the number of clocks during one horizontal period in the display region B is $N_B$. The number of clocks is proportional to a size of the divided display region of the liquid panel 11, that is, to the number of data lines required for driving.

In this state, a condition for which the internal clock signals ca and cb are synchronized with each other (that is, these two signals are in phase) one time during one horizontal period is calculated. The wavelength of the internal clock signal ca in the region A is 1/fa and the wavelength of the internal clock signal cb is 1/fb and, therefore, a difference D between these wavelengths is represented by the following equation (1):

$$\text{Difference } D=1/fb-1/fa \quad (1)$$

However, fa>fb.

If the value to be obtained by dividing the difference D by the number of the internal clocks $N_B$ during one horizontal period is 1/fc, the value 1/fc is represented by the following equation (2):

$$1/fc=(1/fb-1/fa)/N_B \quad (2)$$

If a wavelength to be obtained by subtracting the wavelength 1/fc from the wavelength 1/fb being larger in wavelength out of the internal clock signals ca and cb (that is, being lower in frequency) is 1/fa, the wavelength 1/fa is represented by the following equation (3):

$$1/fa=1/fb-1/fc \quad (3)$$

Figure 3:
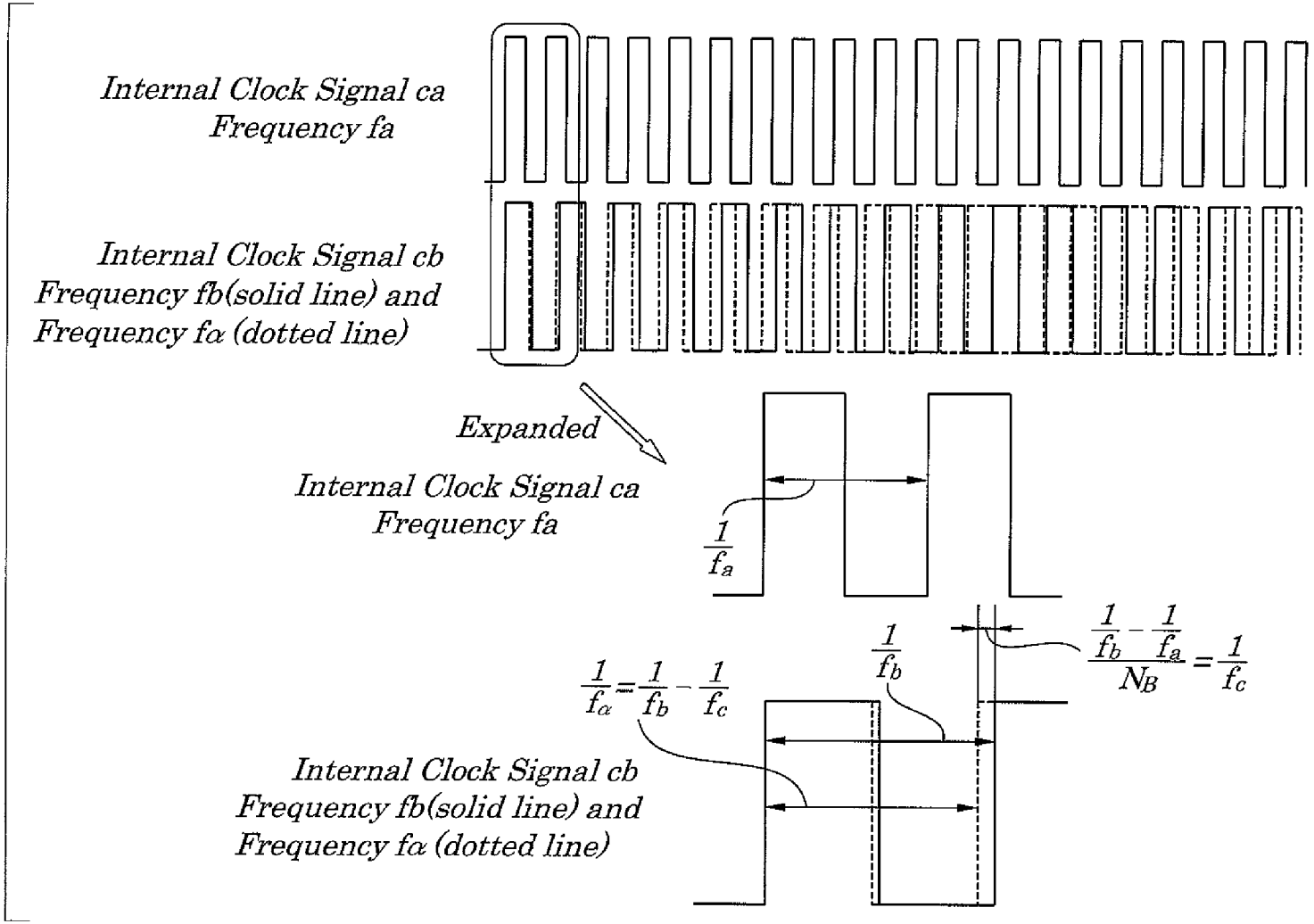
FIG. 3 is a diagram explaining an optimization of one signal and another signal, as an operation example of the liquid crystal display device shown in FIG. 1.
Figure 4:
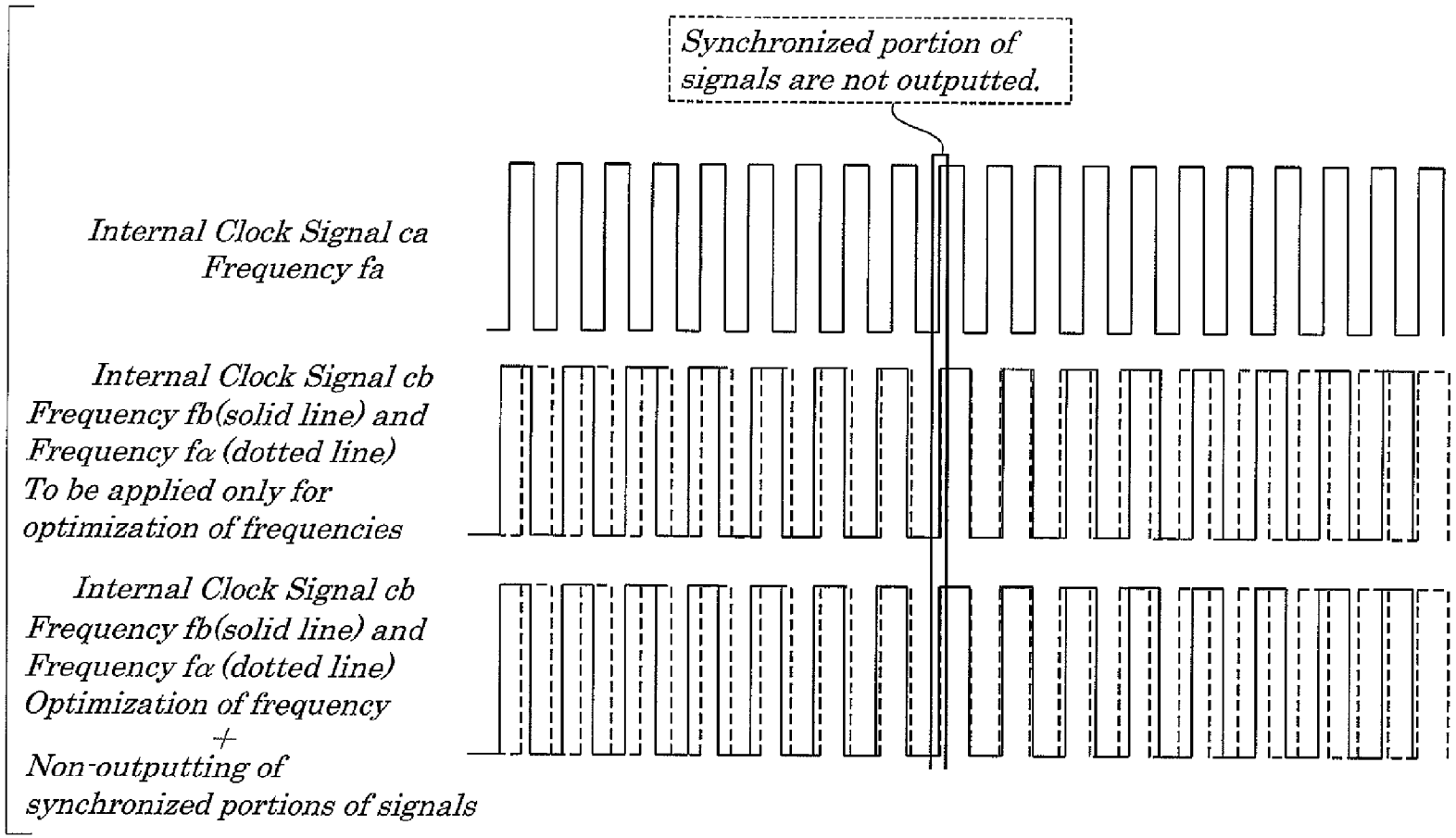
FIG. 4 is a diagram showing waveforms appearing when synchronized portions of the signals are not outputted.

This wavelength 1/fa is applied to the internal clock signal cb. By setting as above, as shown in FIG. 3, when the internal clock signal ca and the internal clock signal cb rise at the same time, the internal clock signal ca is synchronized with the internal clock signal cb (that is, two signals are in phase), which minimizes synchronized portions of the signals. Also, noises can be reduced by setting so that portions of the internal clock signals ca and cb synchronized with each other are not outputted.

Moreover, in the liquid crystal display device shown in FIG. 2, since the number of times of clocks $N_A$ is equal to the number of times of clocks $N_B$, by using ½ of the wavelength 1/fa as the numerator of the right side in the equation (2), the wavelength 1/f c is represented by the following equation (4):

$$1/fc=(1/2fa)/N_B \quad (4)$$

First Exemplary Embodiment

Figure 5:
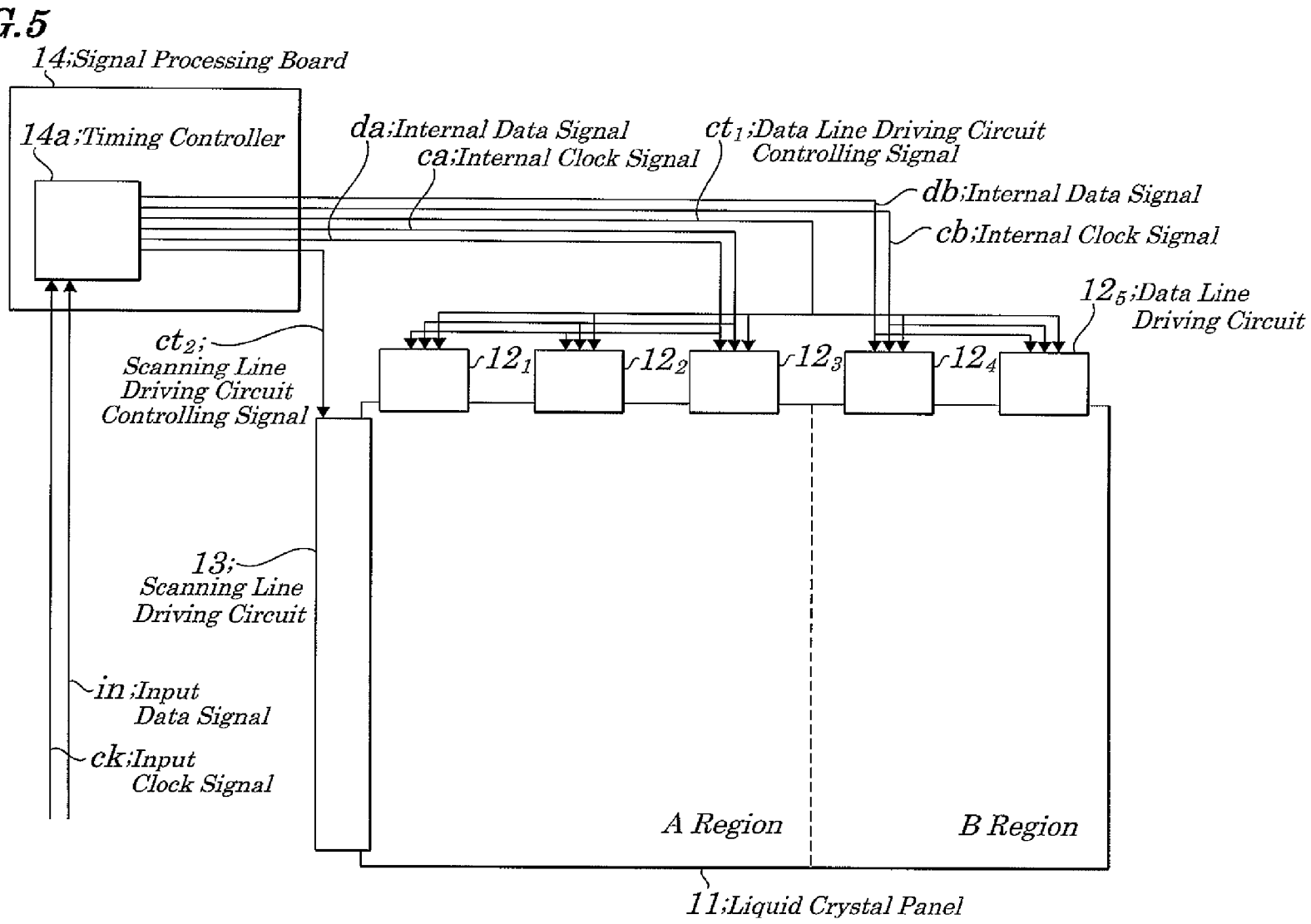
FIG. 5 is a block diagram showing electrical configurations of main portions of a liquid crystal display device according to a first exemplary embodiment of the present invention.

FIG. 5 is a block diagram showing electrical configurations of main portions of a liquid crystal display device of the first exemplary embodiment of the present invention. The liquid crystal display device of the first exemplary embodiment, as shown in FIG. 5, includes a liquid crystal panel 11, data line driving circuits $\mathbf{12}_2$, $\mathbf{12}_2$, . . . $\mathbf{12}_5$, a scanning line driving circuit 13, and a signal processing board 14. The liquid crystal panel 11 has predetermined columns of data lines (not shown), predetermined rows of scanning lines (not shown), and pixels each being mounted at the point of intersection of each of the data lines and scanning lines all of which makes up its display region. In the first exemplary embodiment, the display region of the liquid crystal panel 11 is divided, in a column direction, into two portions, regions A and B, in which the region B is smaller in area than the region A.

Each of the data line driving circuits $\mathbf{12}_2$, $\mathbf{12}_2$, . . . , $\mathbf{12}_5$, in accordance with a data line driving circuit controlling signal $ct_1$ (first controlling signal) supplied from the signal processing board 14 in every one horizontal period, writes pixel data, based on internal data signals da and db, in synchronization with internal clock signals ca and cb corresponding respectively to the region A and region B, to data lines each corresponding to the region A and region B of the liquid crystal panel 11. The above data line driving circuit controlling signal $ct_1$ contains a horizontal (H) side start pulse which starts the transmission of one line of pixel data in the display region. The scanning line driving circuit 13 outputs, based on a scanning line driving circuit controlling signal $ct_2$ (second controlling signal) fed from the signal processing board 14, a scanning line driving signal to each scanning line in a predetermined order, hereby each scanning line being driven in a predetermined order.

The signal processing board 14 has a timing controller **14*a* which outputs, based on an input data signal "in" and an input clock signal ck both making up a video signal, a data line driving circuit controlling signal $ct_1$, internal data signals da and db, and internal clock signals ca and cb to each of the data line driving circuits $\mathbf{12}_2$, $\mathbf{12}_2$, . . . , $\mathbf{12}_5$ and, simultaneously, outputs the scanning line driving circuit controlling signal $ct_2$ to the scanning line driving circuit 13. In the first exemplary embodiment, the timing controller 14*a* has a clock signal frequency setting mode in which the frequency of each of the internal clock signals ca and cb is set to a different value and each of the internal clock signals ca and cb is supplied to each of the data line driving circuits $\mathbf{12}_2$, $\mathbf{12}_2$, and $\mathbf{12}_3$ and each of the data line driving circuits $\mathbf{12}_4$ and $\mathbf{12}_5$ mounted respectively in the region A and region B. Moreover, the timing controller 14*a***, in the clock signal frequency setting mode, sets each of frequencies fa and fb of the internal clock signals ca and cb corresponding respectively to regions A and B to a value at which a period during which the internal clock signals ca and cb are in phase becomes one horizontal period.

Further, the timing controller 14*a*, in the clock signal frequency setting mode, does not output the portions of the internal clock signals ca and cb being in phase. The above one horizontal period includes a period during which the internal data signals da and db are valid (data transmission period) and invalid and the internal data signals da and db are invalid (blank period) and the timing controller 14*a* sets each of the frequencies fa and fb of the internal clock signals ca and cb to a value at which the period during which the internal clock signals ca and cb are in phase falls within a range of the invalid period (that is, not more than the number of pieces of data during the invalid period). In the first exemplary embodiment, the timing controller 14*a* sets each of wavelengths of the internal clock signal cb to a value at which the internal clock signals ca and cb out of the internal clock signals corresponding respectively to the above regions A and B are in phase during one horizontal period.

Figure 6A:
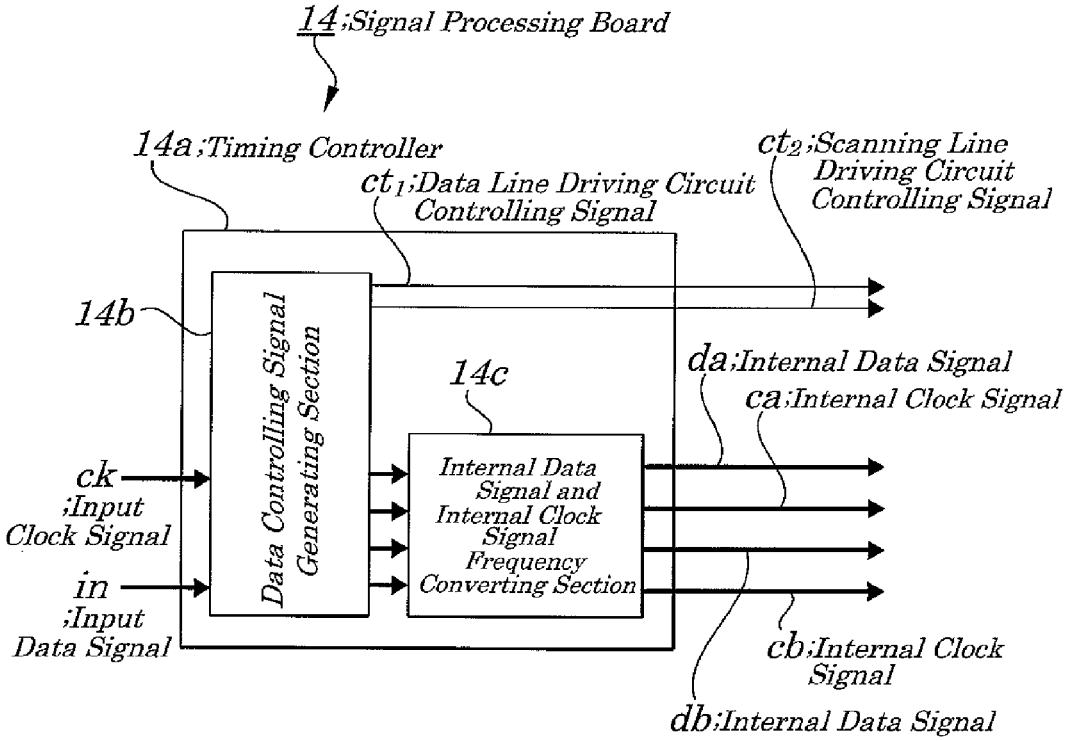
FIG. 6A is a diagram showing a configuration of a signal processing board shown in FIG. 5 according to the first exemplary embodiment of the present invention.
Figure 6B:
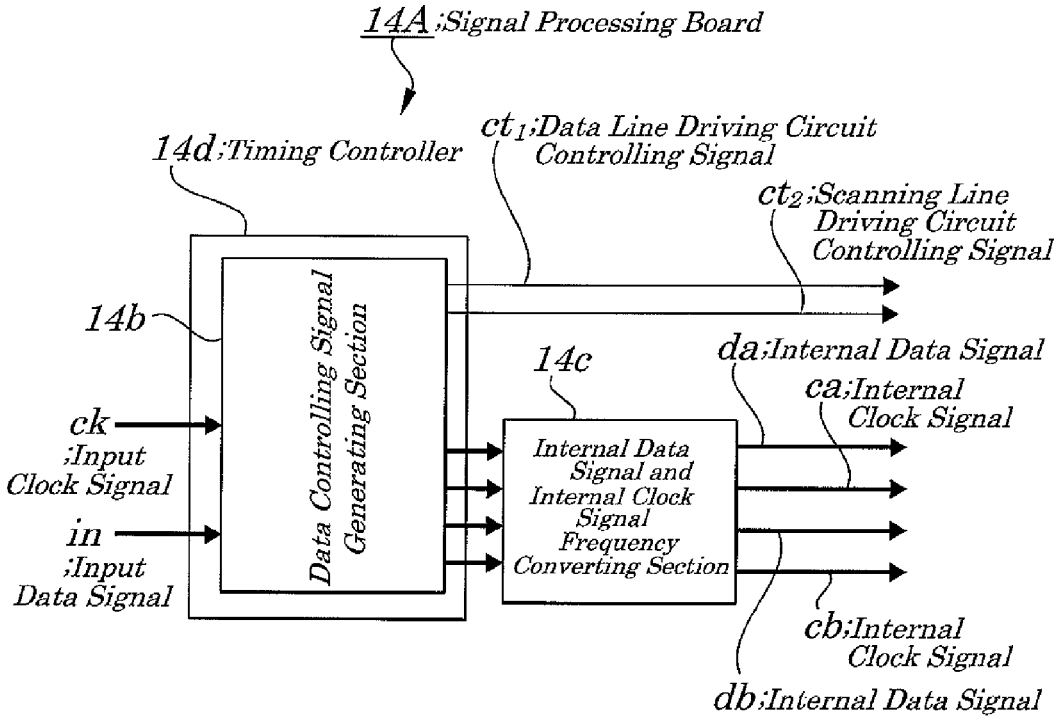
FIG. 6B is a diagram showing a configuration of a signal processing board according to a modification of the first exemplary embodiment.

FIG. 6A is a diagram showing a configuration of a signal processing board shown in FIG. 5 according to the first exemplary embodiment, and FIG. 6B is a diagram showing a configuration of a signal processing board according to a modification of the first exemplary embodiment. The signal processing board 14 has, as shown in FIG. 6A, the timing controller 14*a* which is made up of a data controlling signal generating section 14*b* and an internal data signal and internal clock signal frequency converting section (hereinafter, referred to as a frequency converting section) 14*c*. The data controlling signal generating section 14*b*, based on an input data signal "in" and input clock signal ck, controls the frequency converting section 14*c* and generates a data line driving circuit controlling signal $ct_1$ and scanning line driving circuit controlling signal $ct_2$. The frequency converting section 14*c* outputs an internal data signal da, internal clock signal ca, internal data signal db and internal clock signal cb. As shown in FIG. 6B, instead of the signal processing board 14, a signal processing board 14A may be installed. The signal processing board 14A is made up of a timing controller 14*d* and a frequency converting section 14*c*. The timing controller 14*d* has a data controlling signal generating section 14*b*. The frequency converting section 14*c* is mounted outside the timing controller 14*d*.

FIG. 7 is a diagram obtained by extracting the liquid crystal panel 11, data line driving circuits $\mathbf{12}_1, \mathbf{12}_2, \ldots, \mathbf{12}_5$, scanning line driving circuit 13 and timing controller 14*a* in FIG. 5. Each of the data line driving circuits $\mathbf{12}_1, \mathbf{12}_2, \ldots, \mathbf{12}_5$ is, as shown in FIG. 7, schematically illustrated as a block. The liquid crystal panel 11 is made up of data lines Xi (i=1, 2, . . . , m, for example, m=1600), scanning lines Yj (j=1, 2, . . . , n, for example, n=1200), pixels SPi, j, and common electrode lines COM. To the data lines Xi is applied a voltage corresponding to pixel data Di. To the scanning lines Yj is supplied a scanning line driving signals Gj in a predetermined order. The pixel SPi, j is mounted at the intersection of the data line Xi and scanning line Yj and is made up of a TFT (Thin film transistor) Q, storage capacitor Cst, a liquid crystal capacitor Clc, and the common electrode line COM. The storage capacitor Cst holds a voltage corresponding to supplied pixel data. The liquid crystal capacitor Clc schematically represents a liquid crystal capacitor to display a pixel corresponding to pixel data Di. To the common electrode line COM is also applied a common voltage.

Figure 8:
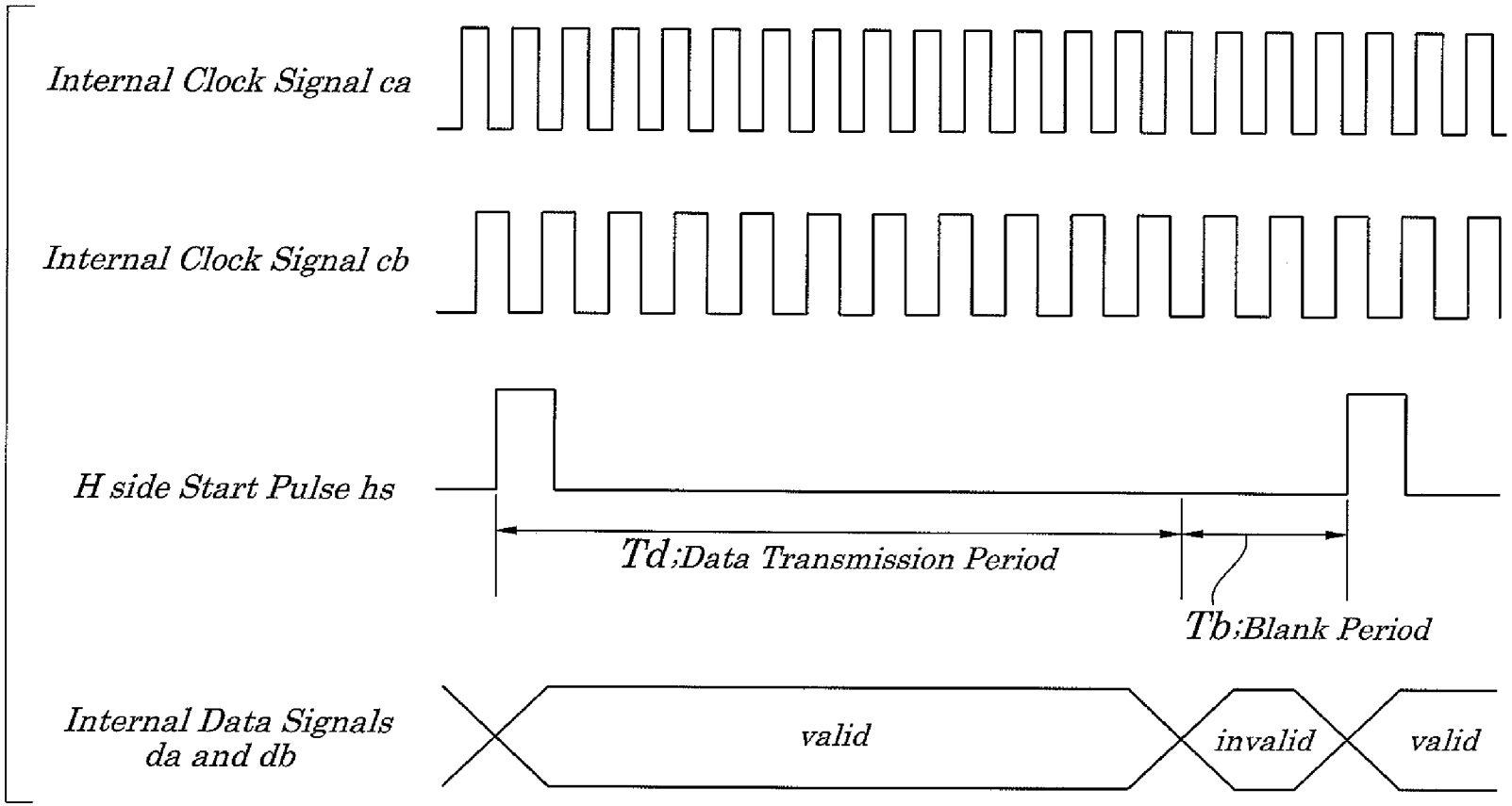
FIG. 8 is a time chart explaining operations of the liquid crystal display device shown in FIG. 5 according to the first exemplary embodiment.
Figure 9:
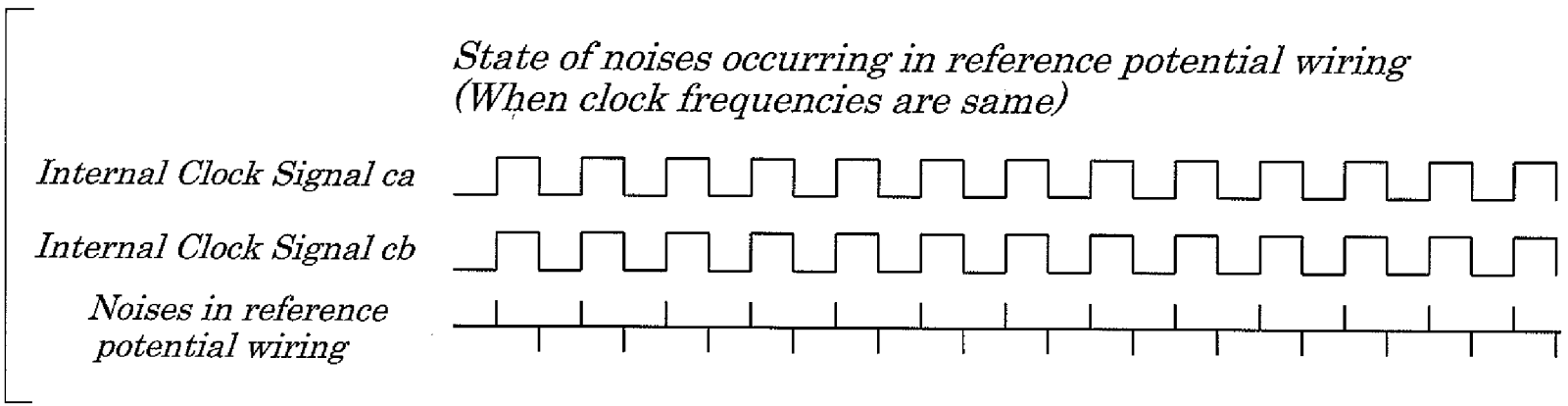
FIG. 9 is a diagram showing a state of noises occurring in a reference potential wiring when frequencies of internal clock signals are the same, according to the first exemplary embodiment.
Figure 10:
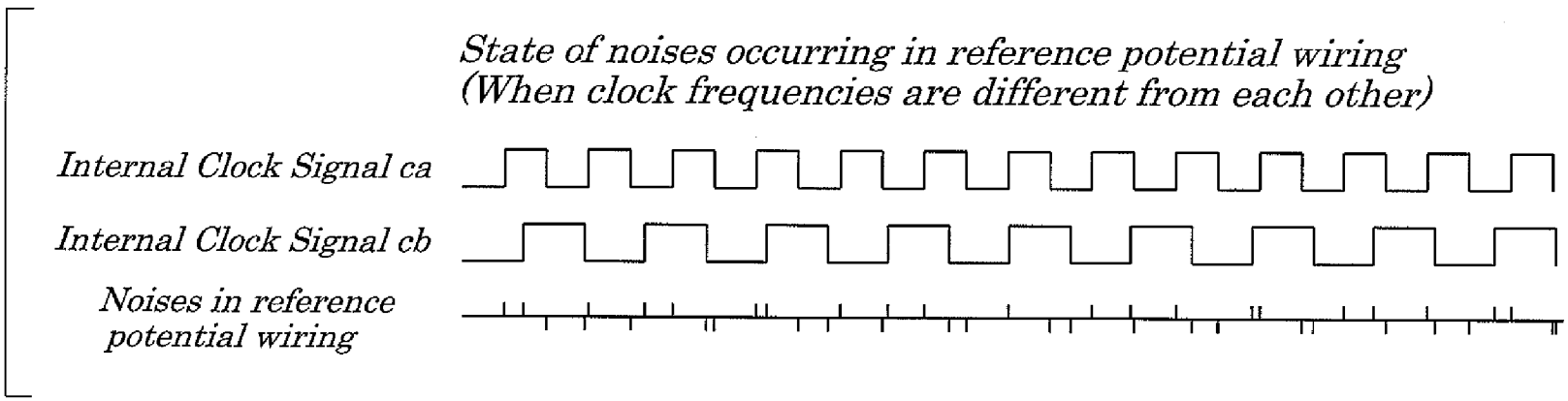
FIG. 10 is a diagram showing a state of noises occurring in the reference potential wiring when frequencies of the internal clock signals are different from each other according to the first exemplary embodiment.

FIG. 8 is a time chart explaining operations of the liquid crystal display device shown in FIG. 5. FIG. 9 is a diagram showing a state of noises occurring in a reference potential wiring when frequencies fa and fb of internal clock signals ca and cb are the same. FIG. 10 is a diagram showing a state of noises occurring in the reference potential wiring when frequencies fa and fb of the internal clock signals ca and cb are different from each other. Hereinafter, contents of processing of a signal processing method to be used in the liquid crystal display device of the exemplary embodiment will be explained with reference to these figures. In the liquid crystal display device, each of the frequencies fa and fb of the internal clock signals ca and cb is set by the timing controller 14*a* to a different value and the internal clock signal ca is supplied to each of the data line driving circuits $\mathbf{12}_1, \mathbf{12}_2, \ldots, \mathbf{12}_5$ and the internal clock signal cb is supplied to each of the data line driving circuits $\mathbf{12}_4$ and $\mathbf{12}_5$ (clock signal frequency setting processing). In this clock signal frequency setting processing, each of the frequencies fa and fb of the internal clock signals ca and cb is set by the timing controller 14*a* to a value at which a period during which the clock signals ca and cb are in phase becomes one horizontal period. Moreover, in this clock signal frequency setting processing, portions of the signals in which the internal clock signals ca and cb are in phase are not outputted by the timing controller 14*a*. Each of the frequencies fa and fb of the internal clock signals ca and cb is set by the timing controller 14*a* to a value at which a period during which the internal clock signals ca and cb are in phase is within the invalid period. In this case, the wavelength of the internal clock signal cb is set by the timing controller 14*a* to a value at which the internal clock signals ca and cb are in phase during one horizontal period.

That is, as shown in FIG. 8, an H side start pulse hs is generated by the timing controller 14*a* during every horizontal period including a data transmission period Td and a blank period Tb, thus causing the transmission signals of the internal clock signals ca and cb and internal data signals da and db to be started. In this case, the frequency fα of the internal signal that can satisfy the equation (3) is set for the internal clock signals cb. The internal data signals da and db become valid during the data transmission period Tb while becoming invalid during the blank period Tb. When the frequencies fa and fb of the internal clock signals ca and cb are the same, as shown in FIG. 9, the state occurs in which the rising of the internal clock signals ca and cb is synchronized with the falling of the signals (the signals being in phase) and noises occurring in the unillustrated reference potential wiring (ground wiring) increase. Contrarily, if the frequencies of the internal clock signals ca and cb are different from each other, as shown in FIG. 10, the state occurs in which the rising of the clock signals ca and cb is not synchronized with their falling (the signals being not in phase), the noises occurring in the reference potential wiring decrease.

Thus, according to the first exemplary embodiment, each of the frequencies fa and fb of the internal clock signals ca and cb is set to a different value and the internal clock signal ca is supplied to the data line driving circuits $\mathbf{12}_1$, $\mathbf{12}_2$, and $\mathbf{12}_3$ and the internal clock signals cb is supplied to the data line driving circuits $\mathbf{12}_4$ and $\mathbf{12}_5$ and, therefore, portions in which phases are superimposed in each of waveforms are reduced, whereby noises occurring in the reference potential wiring decrease. Moreover, each of the frequencies fa and fb of the internal clock signals ca and cb is set to a value at which the period during which the clock signals ca and cb are in phase becomes one horizontal period and portions of the signals in which the internal clock signals ca and cb are in phase are not outputted and, therefore, the occurrence of a great potential change in the reference potential wiring is prevented. Additionally, each of the frequencies fa and fb of the internal clock signals ca and cb is set by the timing controller 14*a* to a value at which the period during which the internal clock signals ca and cb are in phase is within the invalid period, whereby data outputting control processes by the timing controller 14*a* are simplified.

Second Exemplary Embodiment

Figure 11:
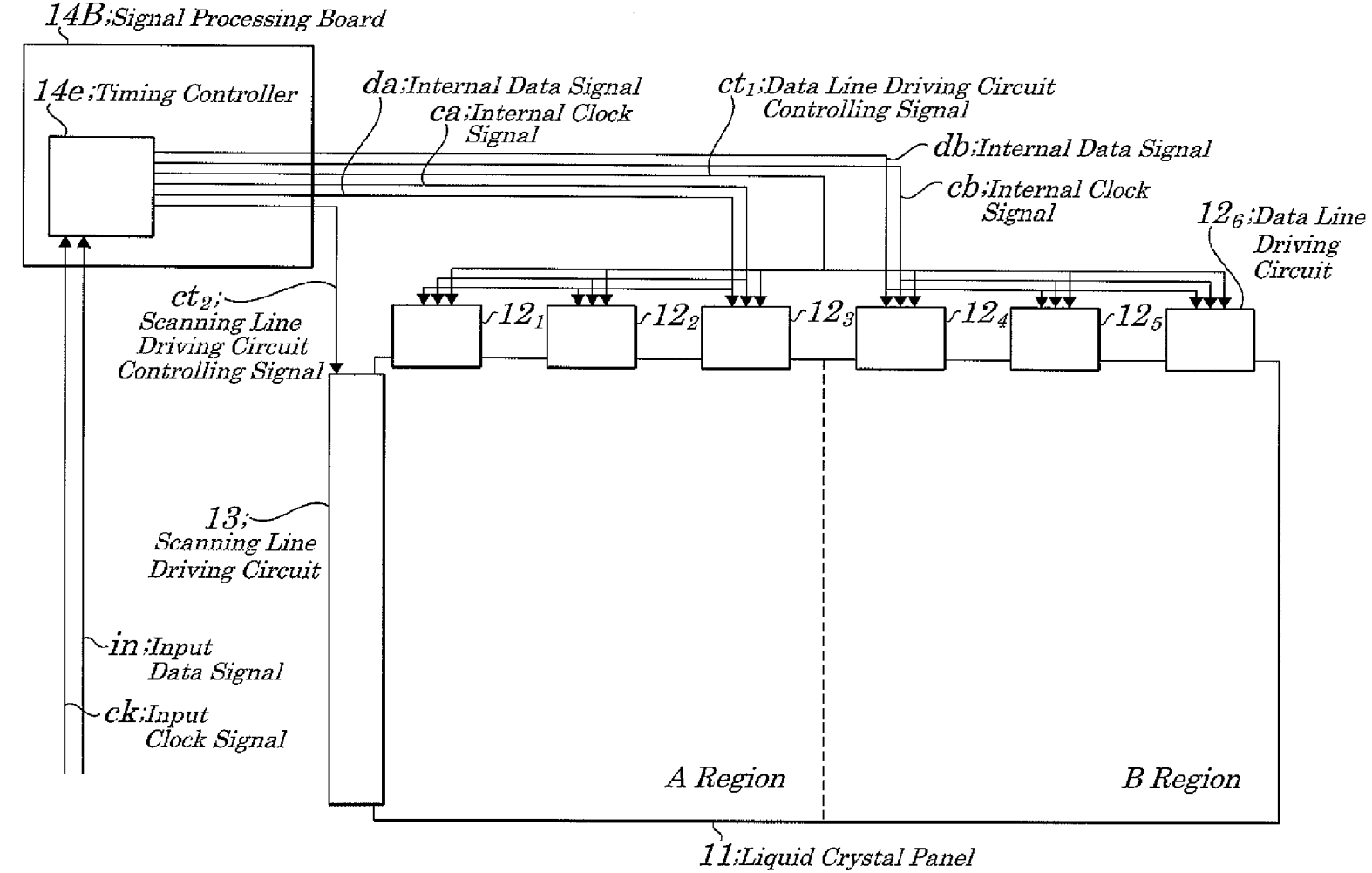
FIG. 11 is a block diagram showing electrical configurations of a liquid crystal display device according to a second exemplary embodiment of the present invention.
Figure 12A:
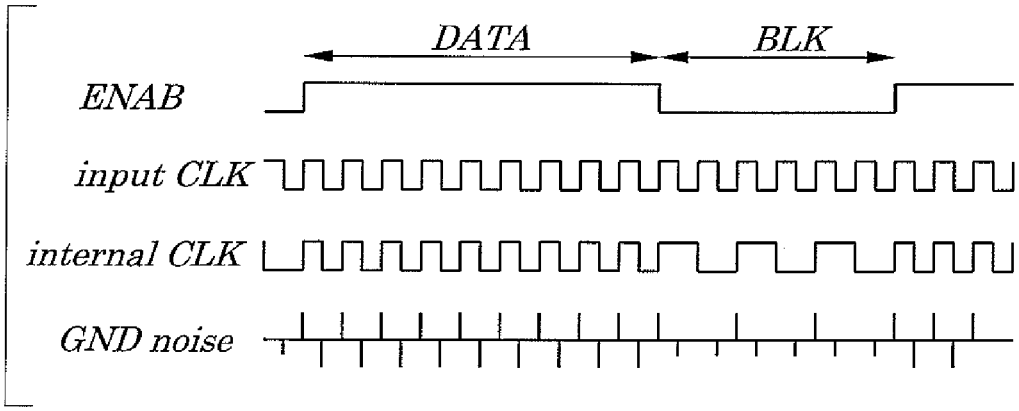
FIG. 12A (RELATED ART)
FIGS. 12A and 12B are diagrams showing a driving method for a liquid crystal display device disclosed in Patent Reference 1 as related art.
Figure 12B:
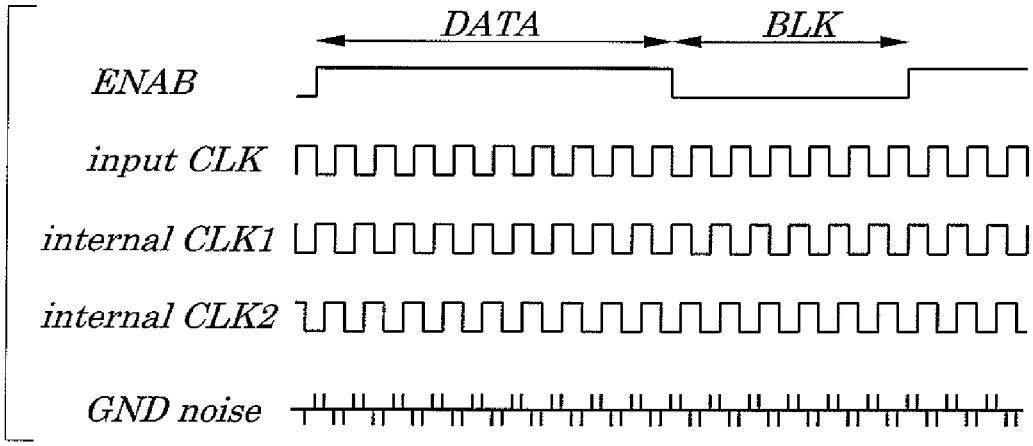
FIG. 12B (RELATED ART)
Figure 13A:
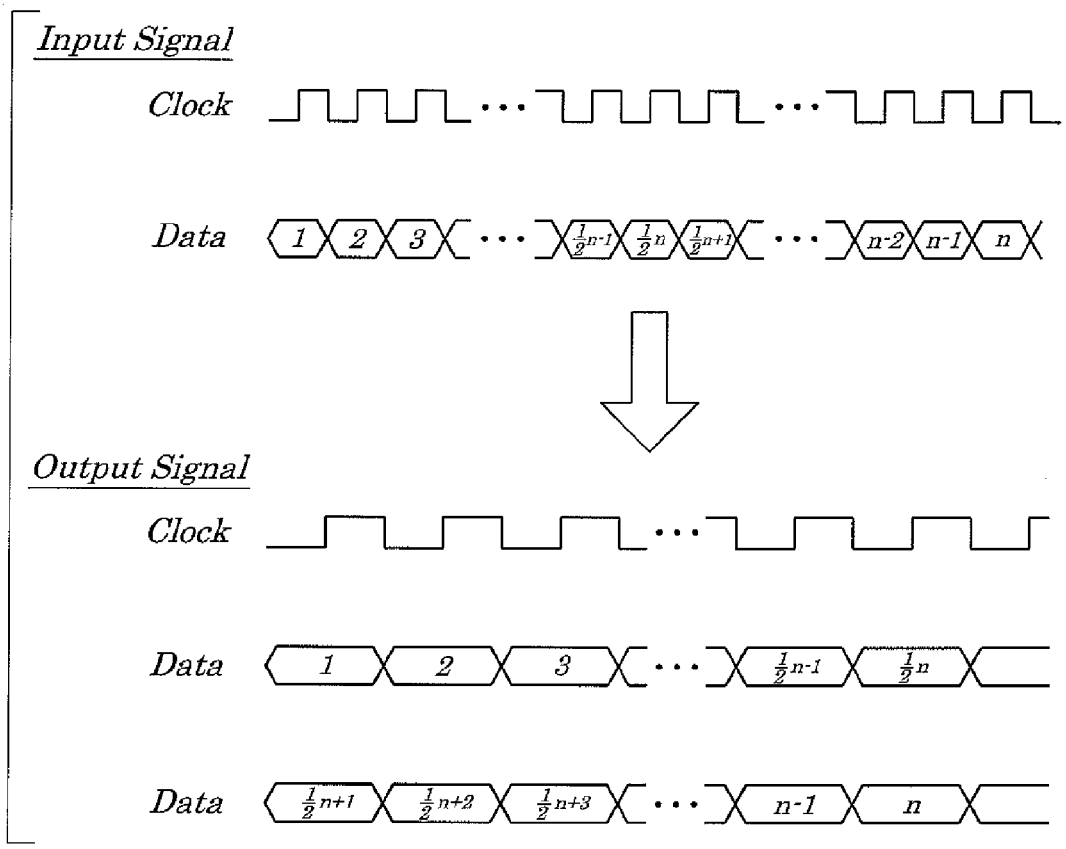
FIG. 13A (RELATED ART)
FIGS. 13A and 13*b* are diagrams showing operations of a liquid crystal display device disclosed in Patent Reference 2 as related art.
Figure 13B:
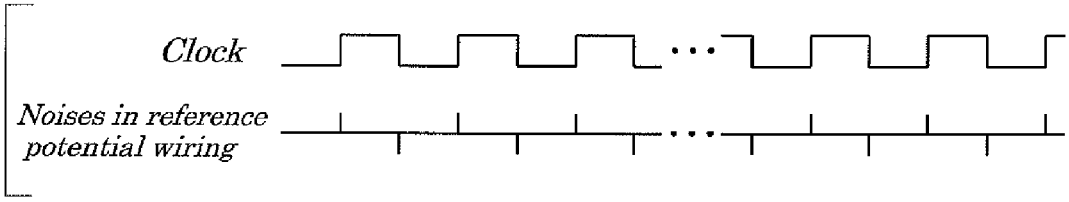
FIG. 13B (RELATED ART)

FIG. 11 is a block diagram showing electrical configurations of a liquid crystal display device of the second exemplary embodiment of the present invention. In the second exemplary embodiment, a display region of a liquid crystal panel 11 is divided, in a column direction, into two portions, regions Ae and Be, in which the region Ae is equal in area to the region Be. Data line driving circuits $\mathbf{12}_1$, $\mathbf{12}_2$, and $\mathbf{12}_3$ and data line driving circuits $\mathbf{12}_4$, $\mathbf{12}_5$, and $\mathbf{12}_6$ are mounted in a manner to be associated respectively with the regions Ae and Be. Instead of the signal processing board 14 (first exemplary embodiment) in FIG. 5, a signal processing board 14B having a different function is mounted. The signal processing board 14B has a timing controller 14*e*. The function of the timing controller 14*e* differs from that of a timing controller 14*a* (first exemplary embodiment) in that a wavelength of an internal clock signal cb out of internal clock signals ca and cb each corresponding to the region Ae and Be is set so as to be one half the above internal clock signal ca.

In the liquid crystal display device of the second exemplary embodiment, the above equation (4) is applied to the internal clock signal cb and the wavelength of the internal clock signal cb is set to one half the internal clock signal ca, whereby the same advantage obtained in the first exemplary embodiment can be achieved.

While the invention has been particularly shown and described with reference to exemplary embodiments thereof, the invention is not limited to these exemplary embodiments. For example, in the above exemplary embodiments, the liquid crystal panel is divided into two display regions, however, the present invention is not limited to division of the liquid crystal panel into the two display regions and the liquid crystal panel may be divided into three or more of display regions.

The present invention can be applied to liquid crystal display devices in general and in particular, is effective in applying a liquid crystal display device being large in size and high definition, in which a numerous amount of image data to be transmitted to its liquid crystal display panel become enormous and the transmission of image data must be further sped up.

What is claimed is:

1. A liquid crystal display device, comprising:

a liquid crystal panel having predetermined columns of data lines, predetermined rows of scanning lines, and pixels each formed at an intersection of each of said data lines and each of said scanning lines;

a data line driving circuit to write, in accordance with a first controlling signal supplied in every horizontal period, pixel data based on a given data signal to each of said data lines in synchronization with a clock signal having a given frequency;

a scanning line driving circuit to output, in accordance with a given second controlling signal, a scanning line driving signal to be used for driving each of said scanning lines in a predetermined order; and a control unit to output, in accordance with a video signal, said first controlling signal, said given data signal, and said clock signal to said data line driving circuit and said second controlling signal to said scanning line driving circuit, wherein said liquid crystal panel is divided in a column direction into a plurality of display regions, wherein said data line driving circuit writes pixel data, in accordance with said given data signal and in synchronization with said clock signal, in every display region of said liquid crystal panel, to each of said data lines, and wherein said control unit sets a frequency of said clock signal in every said display region to a different value such that clock signals in said plurality of said display regions rise at a same time only once every one horizontal period, and supplies the corresponding clock signal in every said display region to said data line driving circuit.

2. The liquid crystal display device according to claim 1, wherein said control unit does not output portions of said clock signals being in phase.

3. The liquid crystal display device according to claim 1, wherein, during said one horizontal period, there is a period during which said data signal is valid and there is a period during which said data signal is invalid, and said controlling device sets a frequency of each of said clock signals to a value at which a period during which said clock signals are in phase is within said invalid period.

4. The liquid crystal display device according to claim 1, wherein, when said display regions of said liquid crystal panel comprise a first display region and a second display region divided in a column direction, in which said first display region is larger in area than said second display region, said control unit outputs a first said clock signal corresponding to said first display region and a second said clock signal corresponding to said second display region, and sets a wavelength of said second clock signal so that said second clock signal is with said first clock signal in phase during one horizontal period.

5. The liquid crystal display device according to claim 1, wherein, when said display regions of said liquid crystal panel comprise a first display region and a second display region divided in a column direction, in which said first display region is equal in area to said second display region, said control unit outputs a first said clock signal corresponding to said first display region and a second said clock signal corresponding to said second display region, and sets a wavelength of said second clock signal so that the wavelength of said second clock signal is one half said first clock signal.

6. A timing controller for a liquid crystal display device having a liquid crystal panel having predetermined columns of data lines, predetermined rows of scanning lines, and pixels each formed at an intersection of each of said data lines and each of said scanning lines, a data line driving circuit to write, in accordance with a first controlling signal supplied in every horizontal period, pixel data based on a given data signal to each of said data lines in synchronization with a clock signal having a given frequency, and a scanning line driving circuit to output, in accordance with a given second controlling signal, a scanning line driving signal to be used for driving each of said scanning lines in a predetermined order and wherein said liquid crystal panel is divided, in a column direction, into a plurality of display regions, wherein said data line driving circuit writes pixel data, in accordance with said given data signal and in synchronization with said clock signal, in every display region of said liquid crystal panel, to each of said data lines, wherein said timing controller outputs, in accordance with a video signal, said first controlling signal, said given data signal, and said clock signal to said data line driving circuit and said second controlling signal to said scanning line driving circuit, sets a frequency of said clock signal in every said display region to a different value such that clock signals in said plurality of said display regions rise at a same time only once every one horizontal period, and supplies the corresponding clock signal in every said display region to said data line driving circuit.

7. The timing controller according to claim 6, wherein portions of said clock signals being in phase are not outputted.

8. The timing controller according to claim 6, wherein, during said one horizontal period, there is a period during which said data signal is valid and there is a period during which said data signal is invalid and a frequency of each of said clock signals is set to a value at which a period during which said clock signals are in phase is within said invalid period.

9. The timing controller according to claim 6, wherein, when said display regions of said liquid crystal panel comprise a first display region and a second display region divided in a column direction, in which said first display region is larger in area than said second display region, a first said clock signal corresponding to said first display region and a second said clock signal corresponding to said second display region are output, and a wavelength of said second clock signal is set so that said second clock signal is with said first clock signal in phase during one horizontal period.

10. The timing controller according to claim 6, wherein, when said display regions of said liquid crystal panel comprise a first display region and a second display region divided in a column direction, in which said first display region is equal in area to said second display region, a first said clock signal corresponding to said first display region and a second said clock signal corresponding to said second display region are output, and a wavelength of said second clock signal so that the wavelength of said second clock signal is one half said first clock signal is set.

11. A signal processing method for use in a liquid crystal display device having a liquid crystal panel comprising predetermined columns of data lines, predetermined rows of scanning lines, and pixels each formed at an intersection of each of said data lines and each of said scanning lines, a data line driving circuit to write, in accordance with a first controlling signal supplied in every horizontal period, pixel data based on a given data signal to each of said data lines in synchronization with a clock signal having a given frequency, a scanning line driving circuit to output, in accordance with a given second controlling signal, a scanning line driving signal to be used for driving each of said scanning lines in a predetermined order, and a control unit to output, in accordance with a video signal, said first controlling signal, said given data signal, and said clock signal to said data line driving circuit and said second controlling signal to said scanning line driving circuit, and wherein said liquid crystal panel is divided in a column direction into a plurality of display regions, wherein said data line driving circuit writes pixel data, in accordance with said given data signal and in synchronization with said clock signal, in every display region of said liquid crystal panel, to each of said data lines, said signal processing method comprising:

clock signal frequency setting processing, in which said control unit sets a frequency of said clock signal in every said display region to a different value such that clock signals in said plurality of said display regions rise at a same time only once every one horizontal period, and supplies the corresponding clock signal in every said display region to said data line driving circuit.

12. A liquid crystal display device, comprising:

a liquid crystal panel having predetermined columns of data lines, predetermined rows of scanning lines, and pixels each formed at an intersection of each of said data lines and each of said scanning lines;

a data line driving means to write, in accordance with a first controlling signal supplied in every horizontal period, pixel data based on a given data signal to each of said data lines in synchronization with a clock signal having a given frequency;

a scanning line driving means to output, in accordance with a given second controlling signal, a scanning line driving signal to be used for driving each of said scanning lines in a predetermined order; and a control means to output, in accordance with a video signal, said first controlling signal, said given data signal, and said clock signal to said data line driving means and said second controlling signal to said scanning line driving means, wherein said liquid crystal panel is divided in a column direction into a plurality of display regions, wherein said data line driving means writes pixel data, in accordance with said given data signal and in synchronization with said clock signal, in every display region of said liquid crystal panel, to each of said data lines, and wherein said control means sets a frequency of said clock signal in every said display region to a different value such that clock signals in said plurality of said display regions rise at a same time only once during each one horizontal period, and supplies the corresponding clock signal in every said display region to said data line driving means.

13. A timing controller to be used for a liquid crystal display device having a liquid crystal panel having predetermined columns of data lines, predetermined rows of scanning lines, and pixels each formed at an intersection of each of said data lines and each of said scanning lines, a data line driving means to write, in accordance with a first controlling signal supplied in every horizontal period, pixel data based on a given data signal to each of said data lines in synchronization with a clock signal having a given frequency, and a scanning line driving means to output, in accordance with a given second controlling signal, a scanning line driving signal to be used for driving each of said scanning lines in a predetermined order and wherein said liquid crystal panel is divided, in a column direction, into a plurality of display regions, wherein said data line driving means writes pixel data, in accordance with said given data signal and in synchronization with said clock signal, in every display region of said liquid crystal panel, to each of said data lines, wherein said timing controller outputs, in accordance with a video signal, said first controlling signal, said given data signal, and said clock signal to said data line driving means and said second controlling signal to said scanning line driving means, sets a frequency of said clock signal in every said display region to a different value such that clock signals in said plurality of said display regions rise at a same time once during every one horizontal period, and supplies the corresponding clock signal in every said display region to said data line driving means.

* * * * *